US010219579B2

(12) United States Patent
Gotti

(10) Patent No.: US 10,219,579 B2
(45) Date of Patent: Mar. 5, 2019

(54) HELMET

(71) Applicant: KASK S.p.A., Chiuduno (BG) (IT)

(72) Inventor: Angelo Gotti, Nembro (IT)

(73) Assignee: KASK S.P.A., Chiuduno (BG) (IT)

( * ) Notice: Subject to any disclaimer, the term of this patent is extended or adjusted under 35 U.S.C. 154(b) by 140 days.

(21) Appl. No.: 15/334,489

(22) Filed: Oct. 26, 2016

(65) Prior Publication Data

US 2017/0112225 A1 Apr. 27, 2017

(30) Foreign Application Priority Data

Oct. 27, 2015 (IT) ..... 102015000065959

(51) Int. Cl.
*A42B 3/22* (2006.01)
*A42B 3/04* (2006.01)

(52) U.S. Cl.
CPC ..... *A42B 3/222* (2013.01); *A42B 3/04* (2013.01); *A42B 3/225* (2013.01)

(58) Field of Classification Search
CPC ..... A42B 3/222; A42B 3/221; A42B 3/18; A42B 3/225
See application file for complete search history.

(56) References Cited

U.S. PATENT DOCUMENTS 4,764,989 A 8/1988 Bourgeois
6,199,214 B1 3/2001 Campbell
6,264,392 B1 7/2001 Wise
8,056,152 B2 * 11/2011 Brace ..... A42B 3/225 2/410
8,214,920 B1 7/2012 Edgar
2004/0199982 A1 * 10/2004 Wang-Lee ..... A42B 3/225 2/424
2009/0241240 A1 10/2009 Han
2009/0293180 A1 12/2009 Grau
2011/0023204 A1 * 2/2011 Brace ..... A42B 3/225 2/8.2
2011/0265236 A1 11/2011 Stoll
(Continued)

FOREIGN PATENT DOCUMENTS

AU 3923468 A 12/1970
JP S6373323 U 5/1988
JP 2003064523 A 3/2003

OTHER PUBLICATIONS

Italian Search Report for Italian Application No. IO 59813 (2 Pages) (dated Jul. 6, 2016).

(Continued)

*Primary Examiner* — Andrew W Sutton
(74) *Attorney, Agent, or Firm* — Lucas & Mercanti, LLP

(57) ABSTRACT

A work or sports protective helmet, with a structure having a substantially convex outer surface; a substantially concave inner surface adapted to receive a user's head in engagement is provided. The helmet also has two coupling and decoupling elements for engagement an accessory, such as a visor, a mask, a net or a similar accessory, each of which can be engaged on a lateral portion of the outer surface of structure. Each coupling and decoupling element can be removed from the helmet and has a body having a coupling mechanism which allows the engagement and the disengagement of the accessory to/from the helmet when the coupling and decoupling elements are engaged on the latter.

14 Claims, 13 Drawing Sheets

(56) References Cited

U.S. PATENT DOCUMENTS

| | | | | |
|---|---|---|---|---|
| 2012/0084904 | A1* | 4/2012 | Paulson | A42B 3/225 2/422 |
| 2012/0144565 | A1 | 6/2012 | Huh | |
| 2012/0291173 | A1 | 11/2012 | Gleason | |
| 2014/0053307 | A1* | 2/2014 | Cheng | A61F 9/06 2/8.2 |
| 2014/0259286 | A1 | 9/2014 | Boyle | |
| 2015/0059057 | A1 | 3/2015 | Pfanner | |

OTHER PUBLICATIONS

Italian Search Report for Italian Application No. IO 59814 (2 Pages) (dated Jul. 6, 2016).
International Search Report for Italian Application No. IO59734 (2 Pages) (dated Jul. 6, 2016).
International Search Report for Italian Application No. IO 59765 (2 Pages) (dated Jul. 8, 2016).
International Search Report for Italian Application No. IO 59754 (2 Pages) (dated Jul. 8, 2016).

* cited by examiner

HELMET

CROSS-REFERENCE TO RELATED APPLICATION

This application claims the benefit of Italian Patent Application No. 102015000065959 filed Oct. 27, 2015, the contents of which are incorporated herein by reference.

BACKGROUND OF THE INVENTION

The present invention relates to a helmet, in particular work or sports protective helmet.

The object of the present invention belongs to the field of helmets, headpieces and/or similar safety protective headgears which can be used during the performing of dangerous and risky activities, such as those carried out in construction sites, mines, oil platforms, by fire-fighters, by first aid providers, by mountain climbers or those carried out in any field where it is necessary to protect the head of the users. The object of the present invention is also suitable to be applied in the field of sports helmets, such as for example those intended for cycling, riding, skiing and for any other sports activity requiring the use of helmets.

As known, work protective helmets generally comprise a structure having at least one convex outer surface and at least one concave inner surface adapted to receive in engagement a user's head.

The inner surface is usually provided with a polystyrene protective shell for absorbing bumps and with possible paddings intended to improve the fit thereof.

The above mentioned helmets can be provided with various accessories arranged on them according to the specific needs.

A particular type of accessory which is often arranged on work as well as on sport helmets, is the face protection accessory, such as visor, mask, net and similar.

In general, helmets with face protection accessories are provided in such a way to have said accessories integrated with the helmets, so that it is not possible to separate them.

Some types of helmets, on the other hand, provides face protection accessories that can be mounted and taken down. However, the provided mechanisms are not easy to use and do not assure a firm connection of the accessories on the helmets.

SUMMARY AND OBJECTS OF THE INVENTION

It is a main purpose of the present invention to provide a helmet which allows an accessory, in particular face protection accessory, to be applied thereto and removed therefrom, ensuring at the same time a firm engagement of said accessory when it is mounted on the helmet.

It is another purpose of the present invention to facilitate the application and the removal of accessories, in particular face protection accessory, on/from the helmets.

The above specified and yet further purposes are substantially achieved by a helmet, in particular work or sports protective helmet, as stated and described in the following claims.

There is now provided, by way of example, the description of a helmet, in particular work or sports helmet, in a preferred but not exclusive embodiment.

BRIEF DESCRIPTION OF THE DRAWINGS

Such description will be made herein below with reference to the accompanying drawings, provided for indicative purposes only and therefore not limiting, wherein.

DETAILED DESCRIPTION OF THE INVENTION

Figure 1:
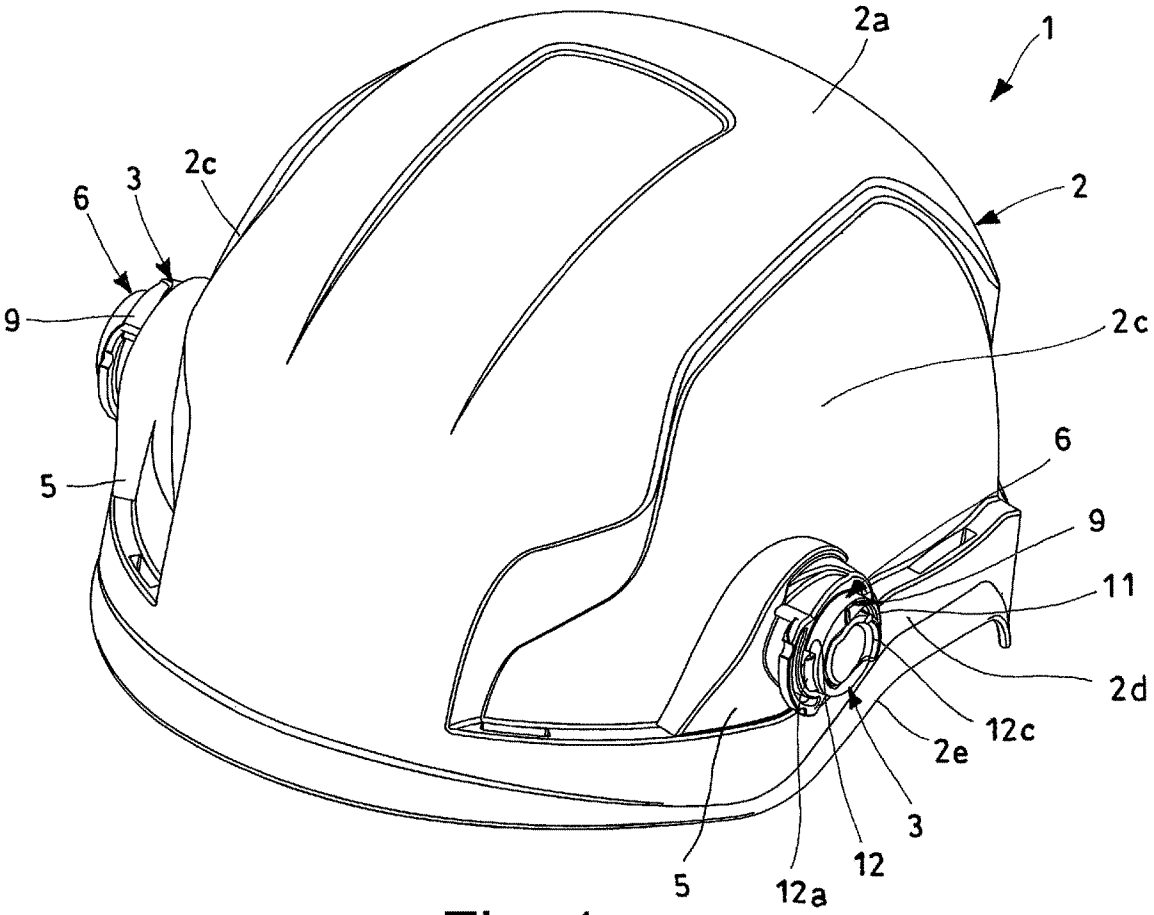
FIG. 1 is a perspective view of a helmet, in particular work protective helmet, according to the present invention, represented with respective coupling and decoupling elements for accessories mounted thereon.
Figure 2:
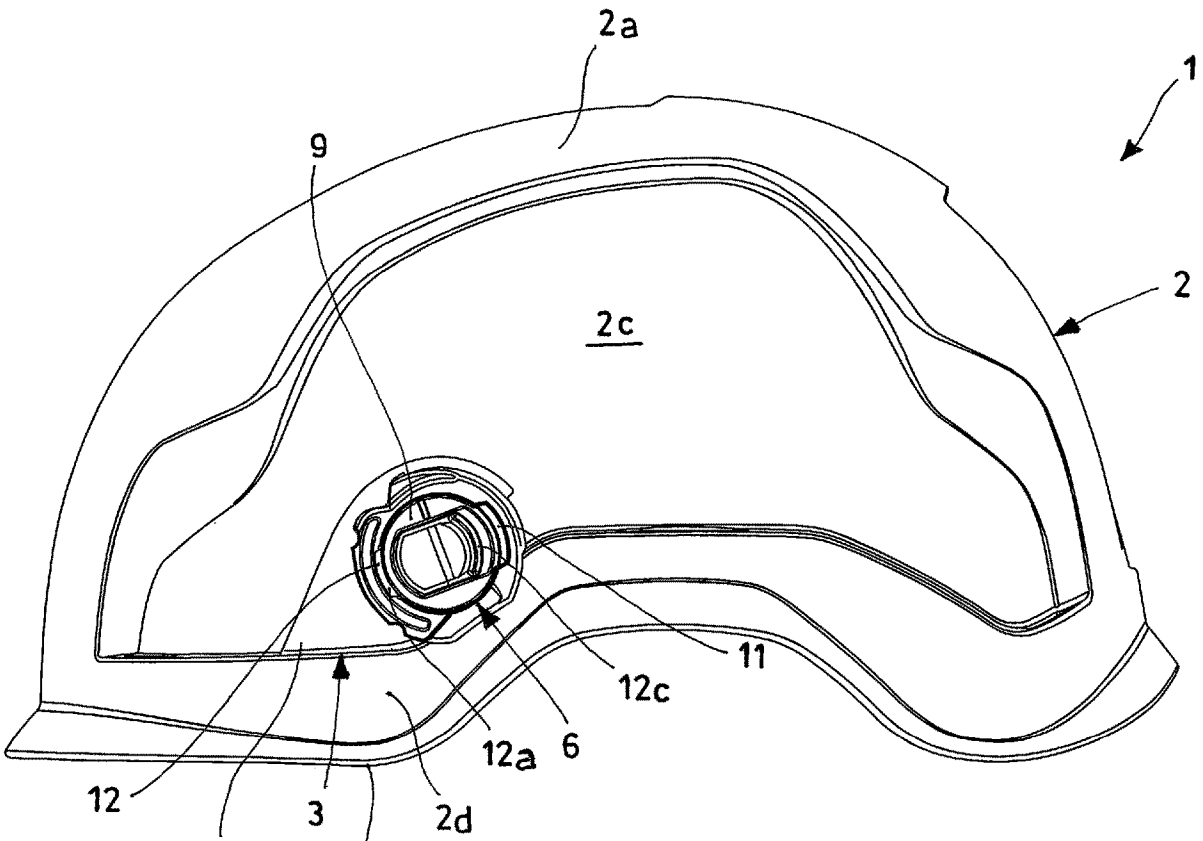
FIG. 2 is a lateral view of the helmet shown in FIG. 1.
Figure 3:
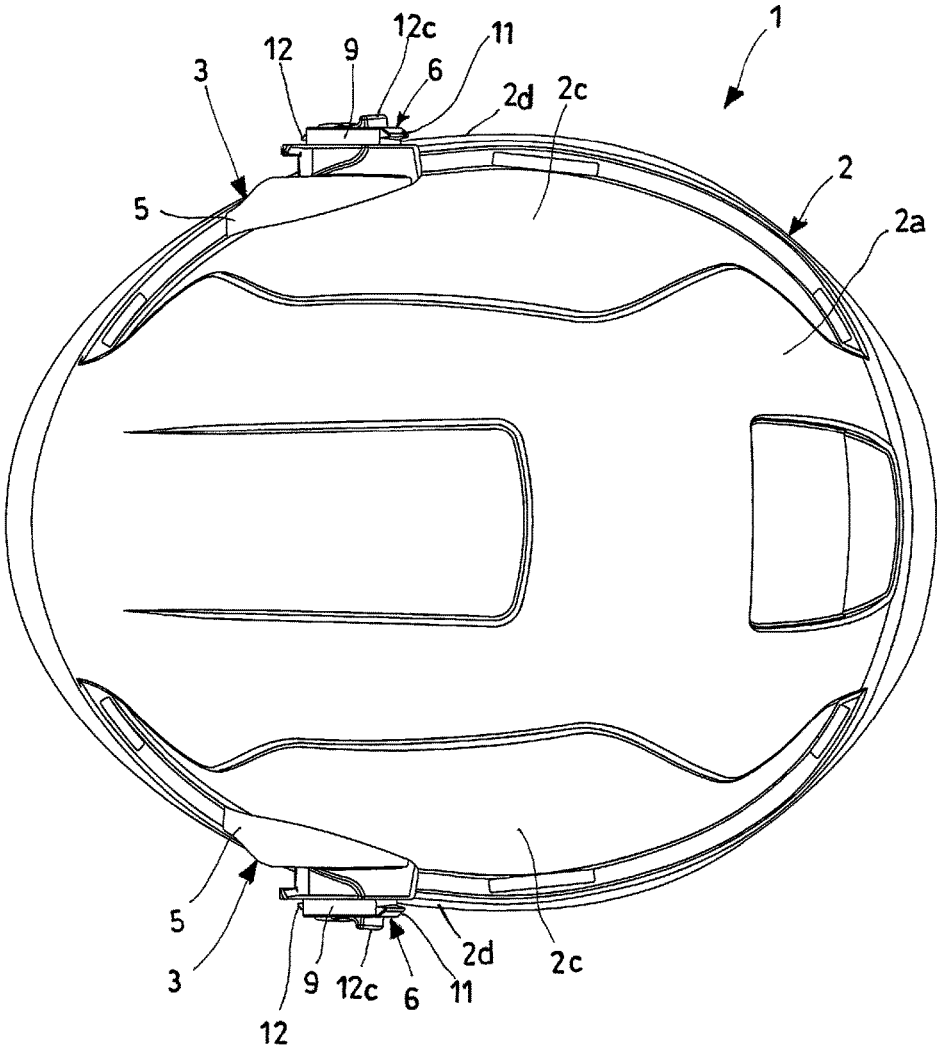
FIG. 3 is a top view of the helmet shown in FIGS. 1 and 2.
Figure 4:
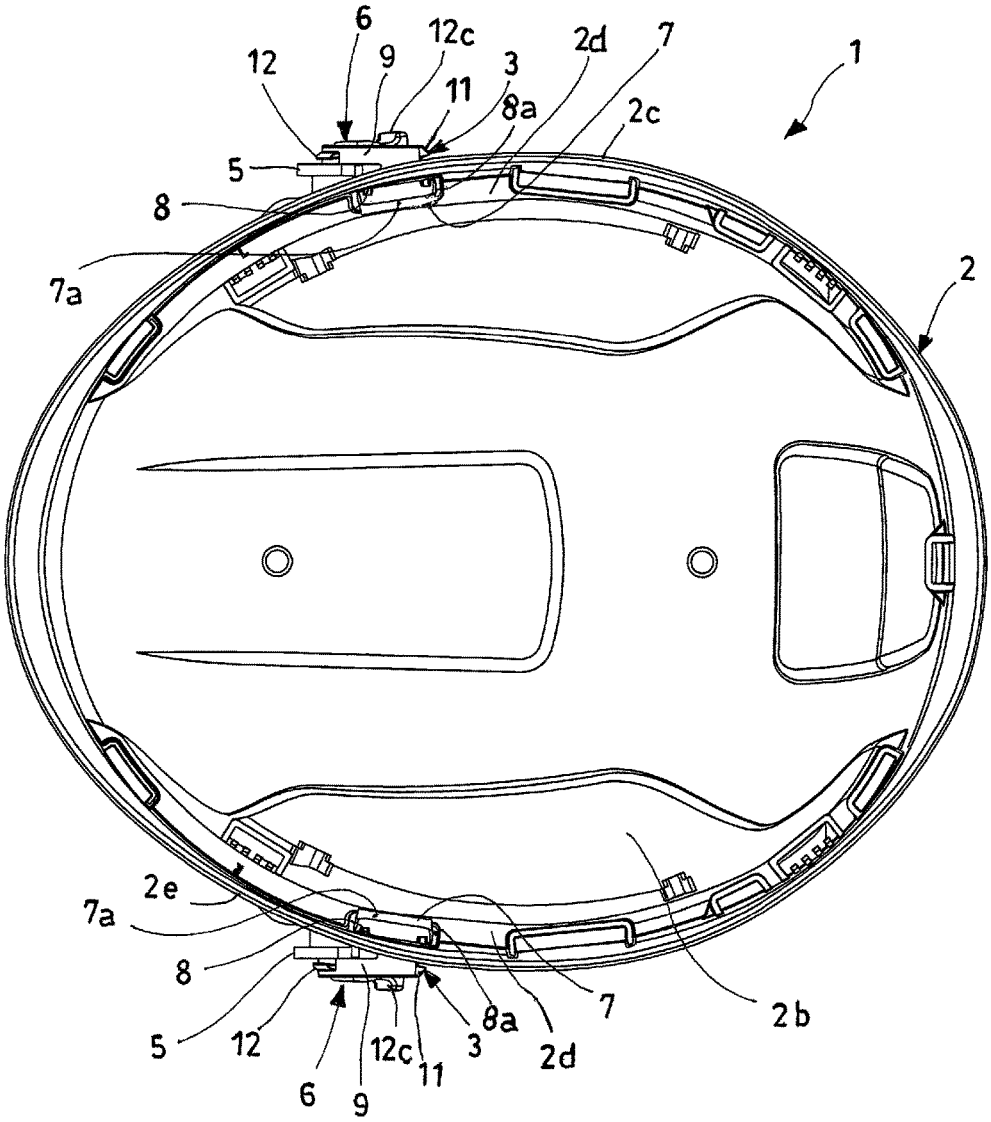
FIG. 4 is a bottom view of the helmet shown in FIGS. 1 to 3.
Figure 5:
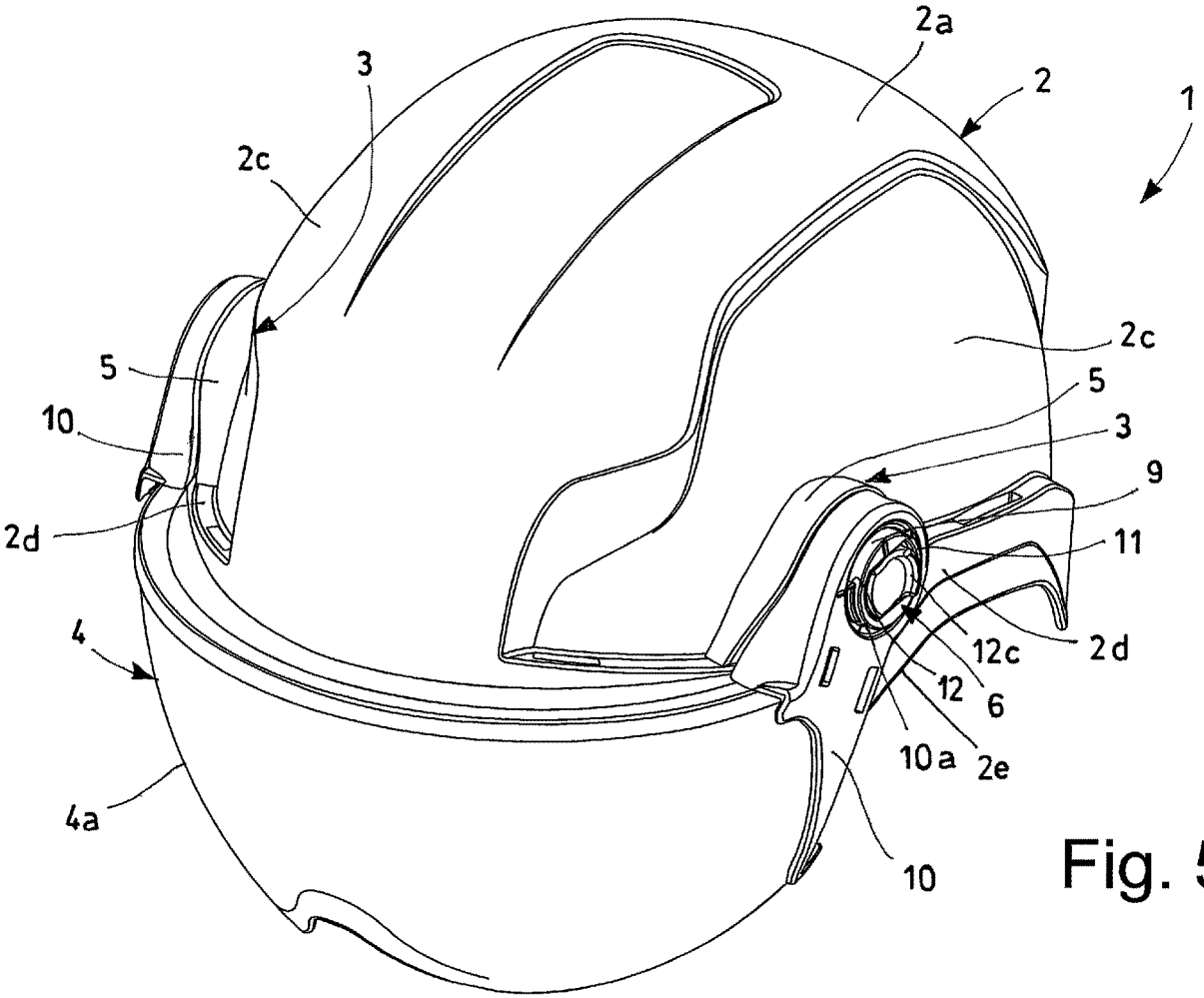
FIG. 5 is a perspective view of the helmet shown in FIGS. 1 to 4, provided with a face protection accessory, i.e. an eyes protection visor.
Figure 6:
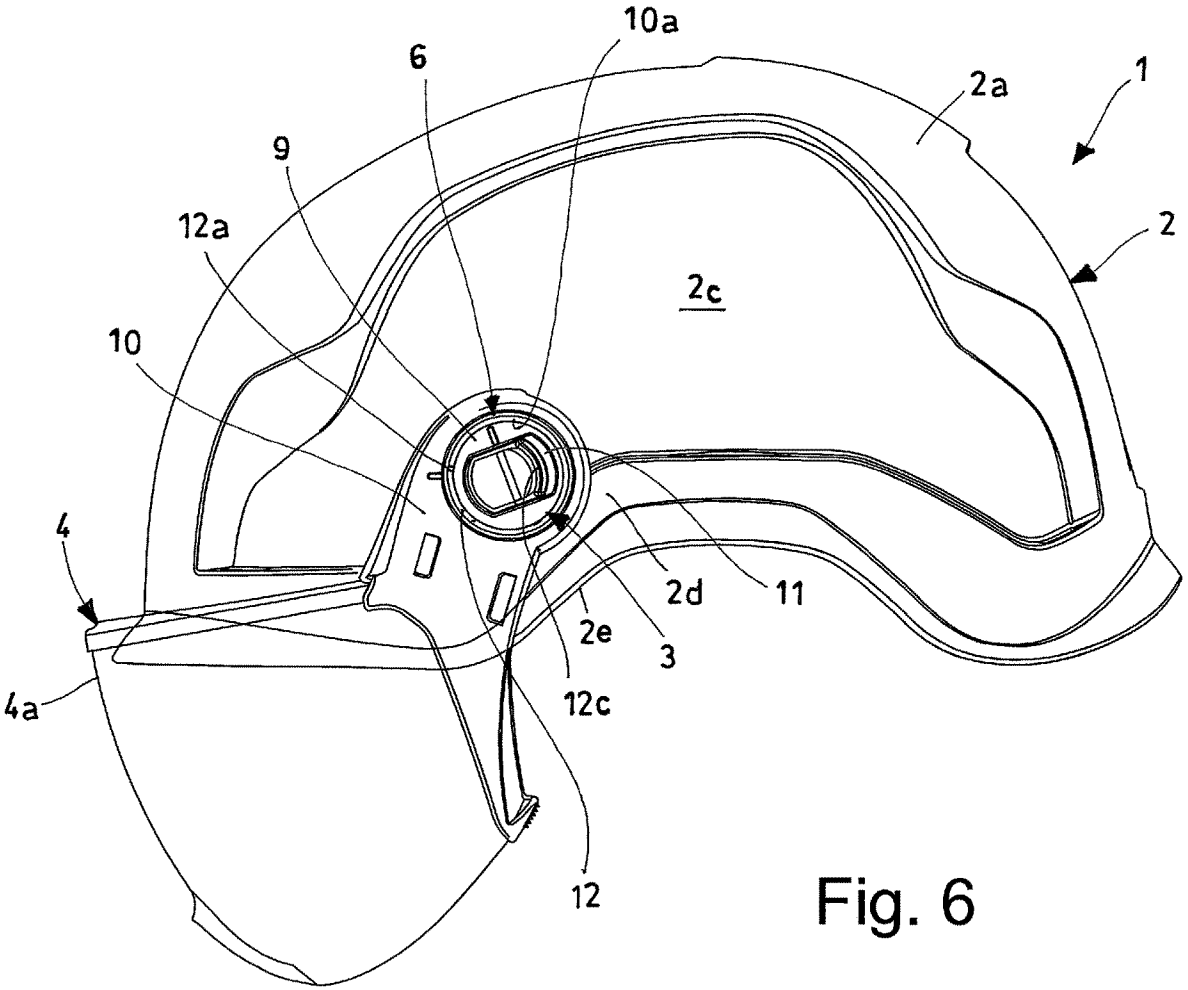
FIG. 6 is a lateral view of the helmet represented in FIG. 5.
Figure 7:
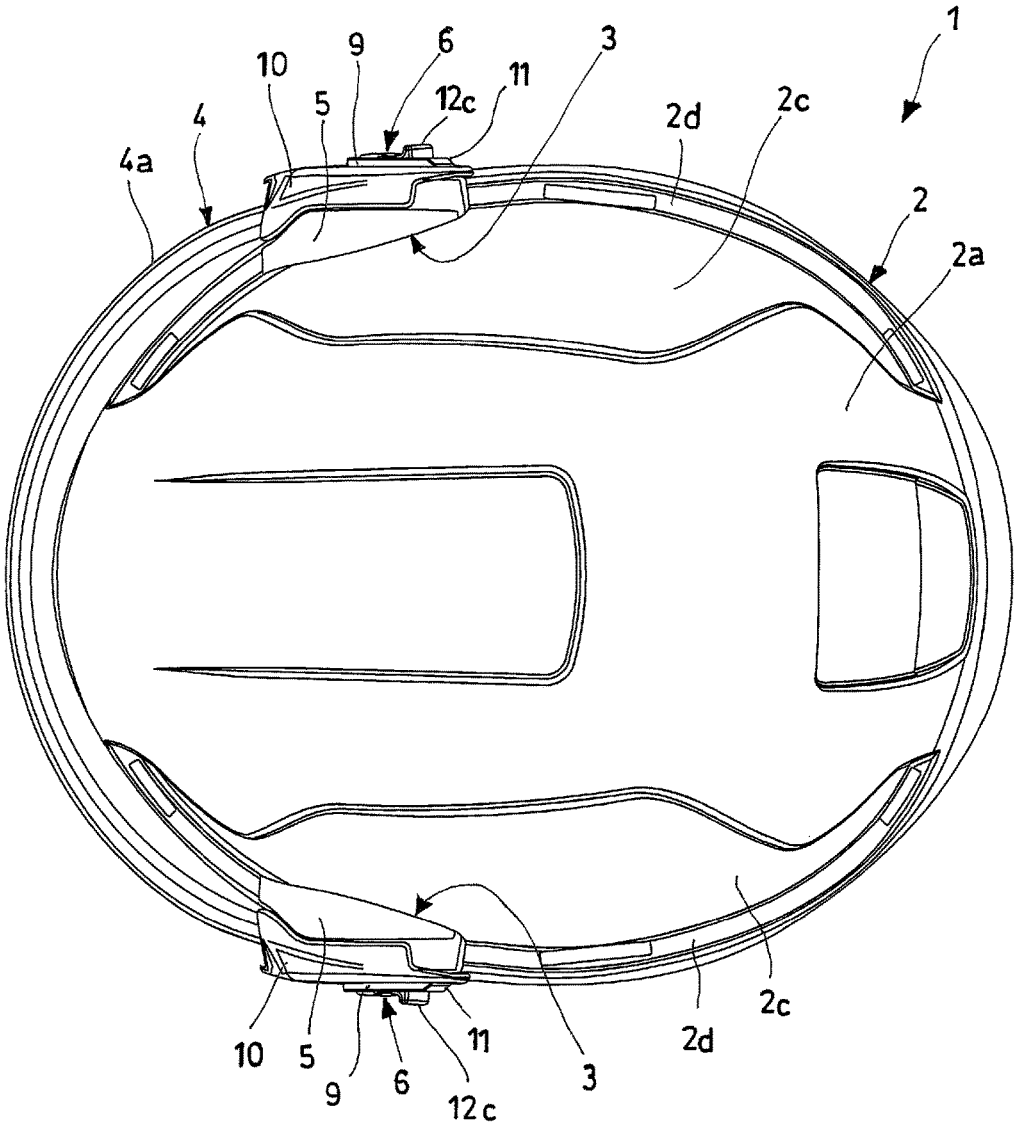
FIG. 7 is a top view of the helmet shown in FIGS. 5 and 6.
Figure 8:
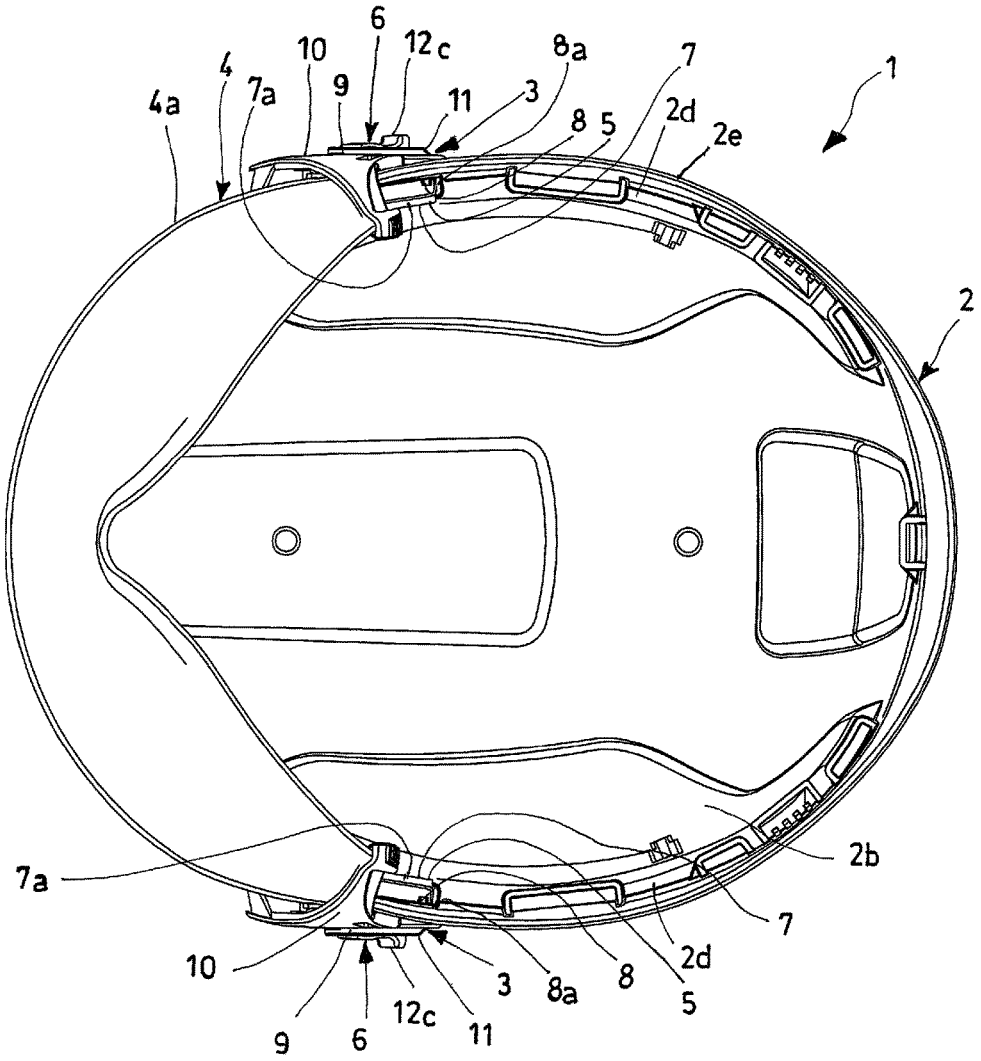
FIG. 8 is a bottom view of the helmet shown in FIGS. 5 to 7.
Figure 9:
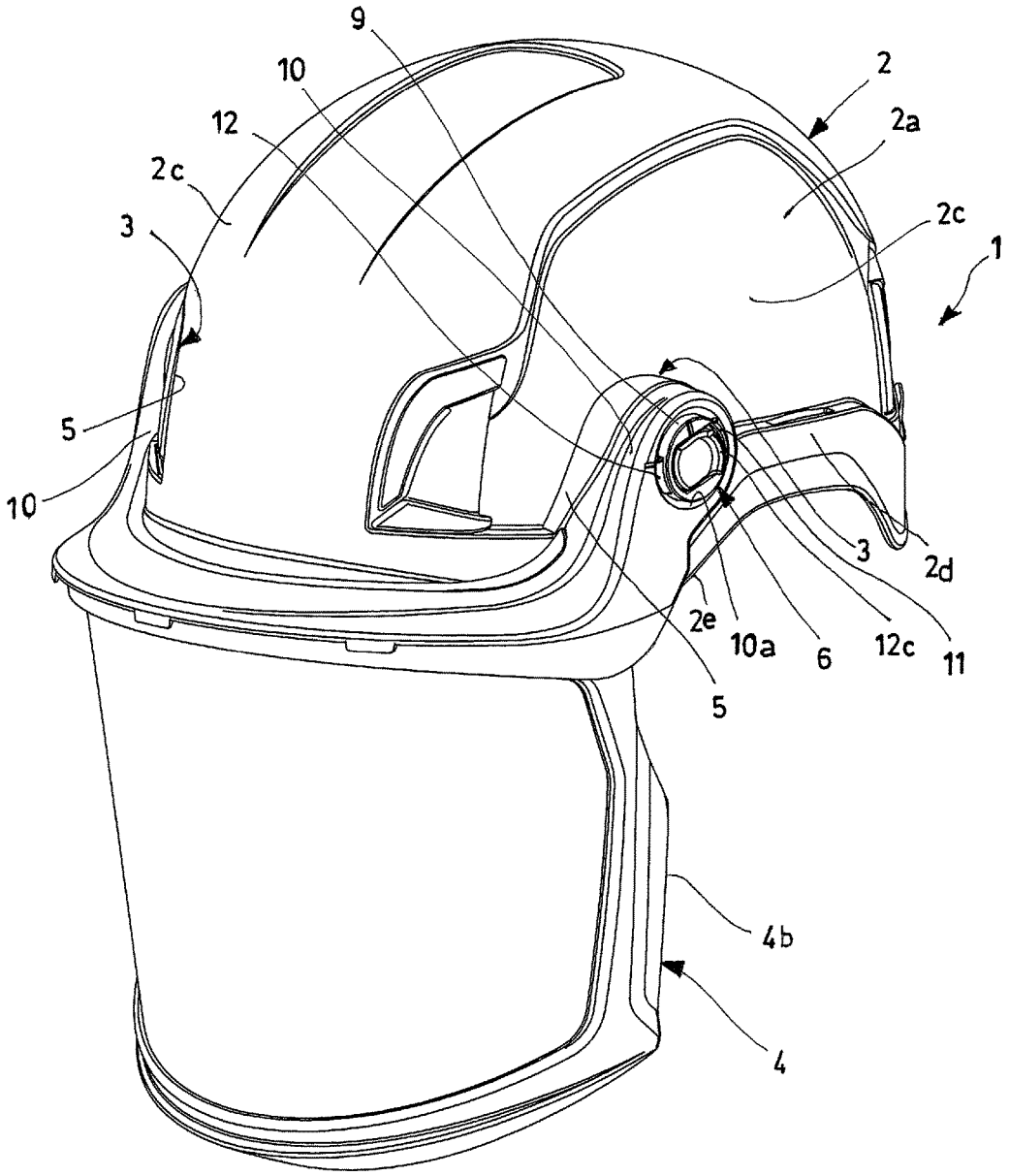
FIG. 9 is a perspective view of the helmet shown in FIGS. 1 to 4, provided with a face protection visor alternative to the eyes protection visor represented in FIGS. 5 to 8.
Figure 10:
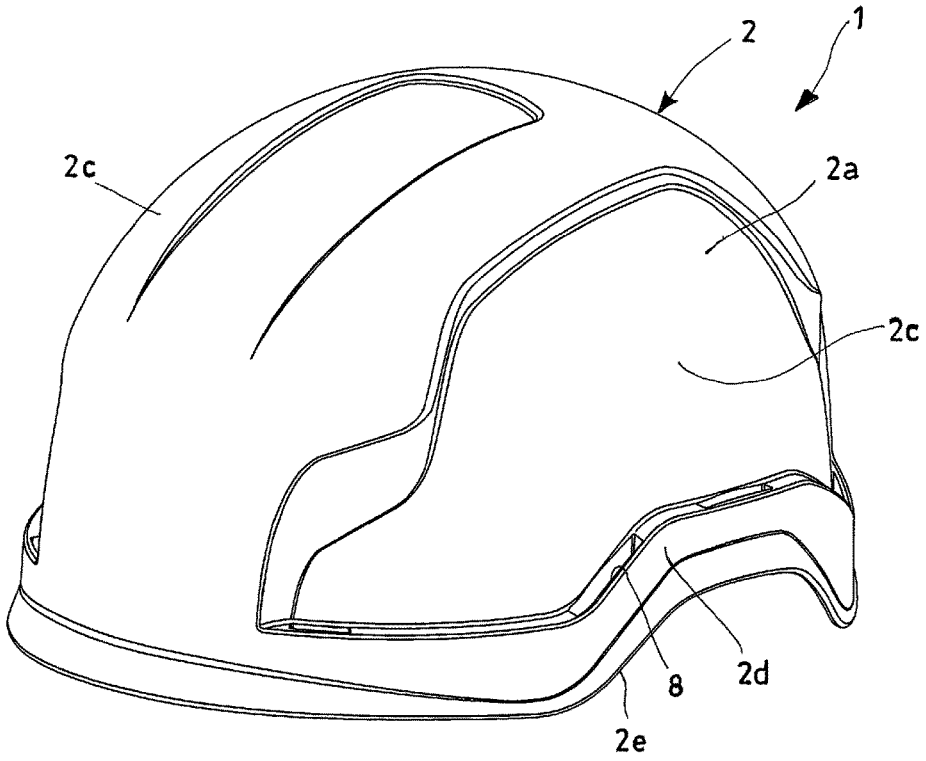
FIG. 10 is a perspective view of the helmet without coupling and decoupling elements for accessories.

With reference to FIGS. 1 to 10, number 1 generally indicates a helmet, in particular work or sports protective helmet, according to the present invention.

The helmet 1 comprises a structure 2 having at least one convex outer surface 2*a* (FIGS. 1 to 3 and 5 to 7, 9 and 10) and at least one concave inner surface 2*b* (FIGS. 4 and 8) adapted to receive a user's head in engagement.

As seen in FIGS. 1 to 9, the helmet 1 comprises two coupling and decoupling elements 3 for the engagement of at least an accessory 4 (FIGS. 5 to 9 and 11 to 15), preferably a face protection accessory 4, in particular a visor 4*a* (FIGS. 5 to 8), a mask 4*b* (FIG. 9), a net or similar accessory, each of which can be engaged on a lateral portion 2*c* of the outer surface 2*a* of structure 2.

Each coupling and decoupling element 3 is advantageously removable from the helmet 1 and has a body 5, having at least one coupling mechanism 6 that allows the engagement and the disengagement of the above mentioned accessory 4 when the coupling and decoupling elements 3 are engaged thereto.

As seen in FIGS. 12 to 15, each coupling and decoupling element 3 of accessory 4 comprises at least one attachment portion 7, which can be inserted in at least one respective attachment opening 8, obtained on the helmet 1.

In detail, each attachment opening 8 obtained on the helmet 1 is obtained through a peripheral edge 2*d*, which is arranged near to the base 2*e* thereof.

Preferably, each attachment opening 7 is obtained through the respective peripheral edge 2*d* of the helmet 1 and develops substantially parallel or tangential to the outer surface 2*a* thereof, so that the engagement of the respective coupling and decoupling element 3 for the accessory 4 is carried out along a direction substantially parallel or tangential to the outer surface 2*a* of helmet 1.

The attachment portion 7 of each coupling and decoupling element 3 can be inserted in a snap-fit manner in the respective attachment opening 8 of helmet 1.

The attachment portion 7 of each coupling and decoupling element 3 can be engaged by interference in the respective attachment opening 8 of helmet 1.

Each attachment opening 8 of helmet 1 is substantially square-shaped, preferably rectangular, and the attachment portion 7 of each coupling and decoupling element 3 is substantially plate-shaped with a substantially square-shaped section, preferably rectangular.

Figure 11:
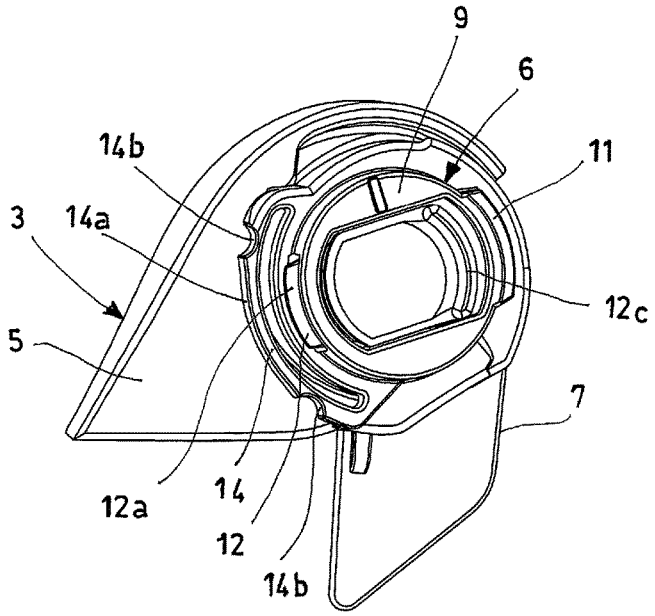
FIG. 11 is a perspective view of a coupling and decoupling element, shown in FIGS. 1 to 9.
Figure 12:
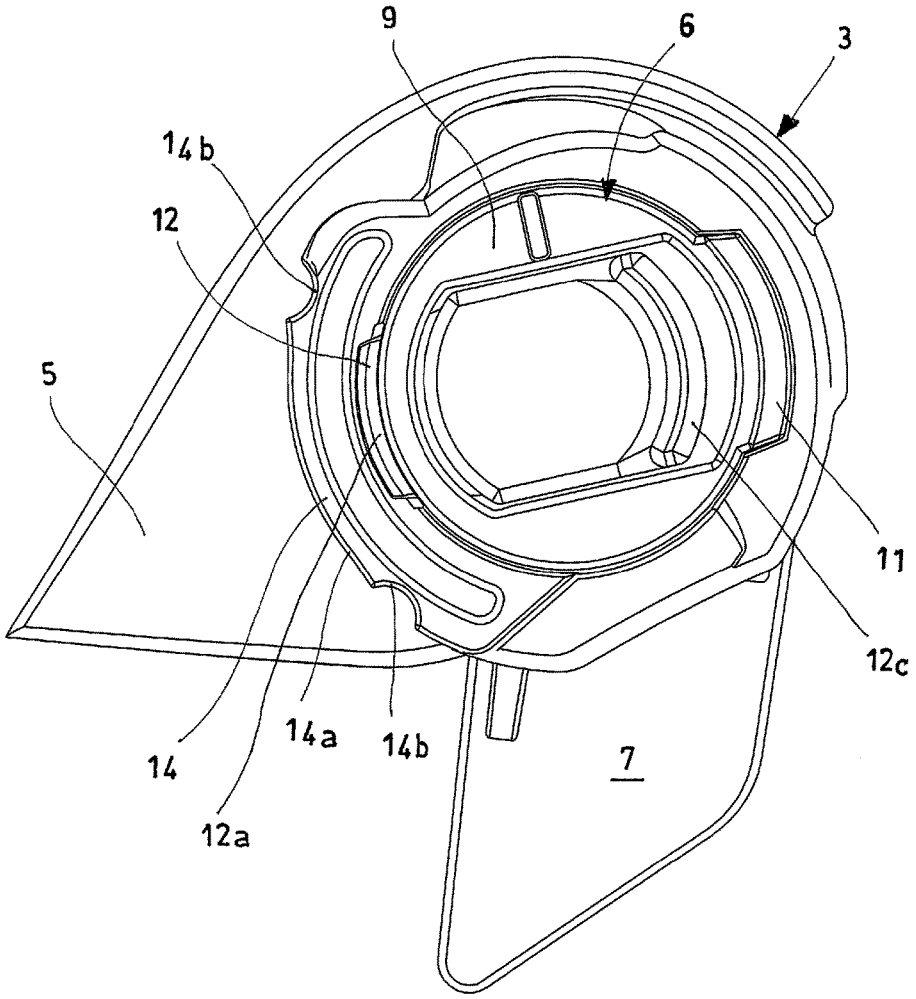
FIG. 12 is an elevation view of the coupling element of FIGS. 1 to 9 and 11.
Figure 13:
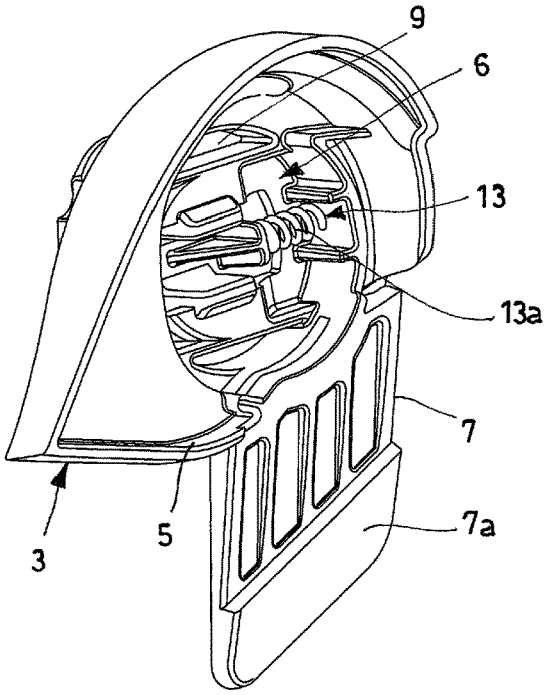
FIG. 13 is a further perspective view of the coupling and decoupling element of FIGS. 1 to 9, 11 and 12.

As seen in FIGS. 11 to 13, the attachment portion 7 of each coupling and decoupling element 3 extends cantilevered from the body 5 of the latter.

Preferably, the attachment portion 7 of each coupling and decoupling element 3 tapers away from the body 5 of the latter and ends with an enlarged end 7*a* defining at least one abutment tooth for coupling with a respective abutment edge 8*a* (FIG. 4) of the respective attachment opening 8 arranged inside the helmet 1.

The attachment portion 7 of each coupling and decoupling element 3 is advantageously elastically deformable, at least transversely with respect to its longitudinal extension, in order to guarantee its snap-fit engagement in the respective attachment opening 8 of helmet 1 and the disengagement from the same.

In detail, when each coupling and decoupling element 3 is applied on the helmet 1, the respective attachment portion 7 is inserted in the respective attachment opening 8 of the helmet 1. During the insertion, the enlarged end 7*a* of the respective attachment portion intercepts the inner wall of the respective attachment opening 8*a*, slightly bending the latter towards the opposite wall. Once the enlarged end 7*a* of the respective attachment portion 7 goes beyond the inner abutment edge 8*a* of the respective attachment opening 8, the attachment portion 7 assumes its own original orientation by coupling to the respective abutment edge 8*a*.

The disengagement of the attachment portion 7 of the respective coupling and decoupling element 3 from the attachment opening 8 of the corresponding helmet 1 can be carried out easily by acting manually on the respective enlarged end 7*a*. In this case, the attachment portion 7 bends as much as to allow the respective enlarged end 7*a* to fit inside the respective attachment opening 8, enabling the attachment portion 7 to slip off from the latter.

The above mentioned coupling mechanism 6 of each coupling and decoupling element 3 for coupling and decoupling the face protection accessory 4 comprises at least an engagement portion 9 projecting from the respective body 5 transversely with respect to the main development of the respective attachment portion 7.

The engagement portion 9 of the coupling mechanism 6 of each coupling and decoupling element 3 is shaped so as to receive a respective engagement portion 10 of each accessory 4 in engagement whereon an engagement seat 10*a* is obtained, at least partially counter-shaped with respect to the engagement portion 9.

In order to allow the relative rotation between the accessory 4 and the helmet 1 on which it is mounted, the engagement portion 9 of the coupling mechanism 6 of each coupling and decoupling element 3 is substantially cylindrical and the engagement seat 10*a* of the respective engagement portion 10 of the accessory 4 is defined by a circle-shaped through opening.

Going into further detail, the coupling mechanism 6 of each coupling and decoupling element 3 comprises at least one fixed coupling abutment 11 which projects in a transversal manner from the respective engagement portion 9 of the coupling mechanism itself. When the engagement portion 10 of the accessory 4 is mounted on the respective coupling element 3, it rests between the respective fixed abutment 11 and the respective body 5 of the latter.

The coupling mechanism 6 of each coupling and decoupling element 3 further comprises at least one movable coupling abutment 12 transversely projecting from the respective engagement portion 9 on the opposite side with respect to the fixed coupling abutment 11 of the same coupling mechanism 6.

Advantageously, the movable coupling abutment 12 of the coupling mechanism 6 of each coupling and decoupling element 3 is switchable between a first position, in which it projects at least partially from the engagement portion 9 of the respective coupling mechanism 6 in order to hold the respective engagement portion 10 of an accessory 4 when the latter is mounted on the respective coupling and decoupling element 3, and a second position, in which it does not project from the engagement portion 9 of the respective coupling mechanism 6 allowing the application of an accessory 4 on the respective coupling and decoupling element 3 or the removal of the same from the respective coupling or decoupling element 3.

The movable coupling abutment 12 of the coupling mechanism 6 of each coupling and decoupling element 3 is operatively associated with elastic return means 13, preferably at least one helical spring 13*a* (FIG. 13) that maintains or returns the respective movable coupling abutment 12 to the first position, in the absence of forces capable of leading the latter towards the second position.

Advantageously, the movable abutment element 12 has a profile, in longitudinal section (FIGS. 14 *e* 15), having a first inclined surface 12*a* tapering towards the body 5 of the respective coupling and decoupling element 3 away from the engagement portion 7 of the respective coupling mechanism 6. The first inclined surface 12*a* switches the respective movable coupling abutment 12 from the first to the second position when an engagement portion 10*a* of an accessory 4 is fitted on the respective engagement portion 9 of the respective coupling mechanism 6 of the respective coupling and decoupling element 3 and pushed towards the body 5 of the latter. In this case, the engagement portion 10 of the accessory 4 intercepts the first surface 12*a* of the movable coupling abutment 12 switching it from the first to the second position, whereby the engagement portion 10 of the accessory 4 can assume the correct resting position on the engagement portion 9 of the respective coupling and decoupling element 3. Once the engagement portion 10 of the accessory is fitted on the engagement portion 9 of the respective coupling and decoupling element 3, the movable coupling abutment, free from counter forces, is brought by the elastic return means 13 from the second position to the first position, blocking the engagement portion 10 of the accessory mounted on the respective coupling and decoupling element 3.

Figure 14:
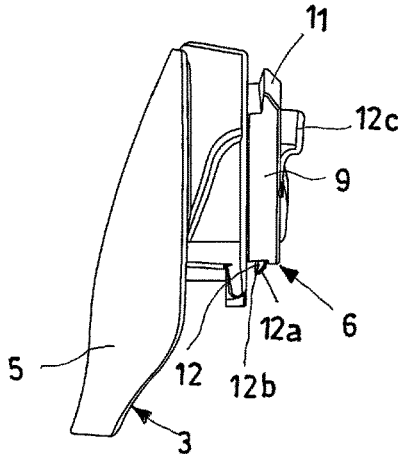
FIG. 14 is a top view of the coupling and decoupling element of FIGS. 1 to 9 and 11 to 13.
Figure 15:
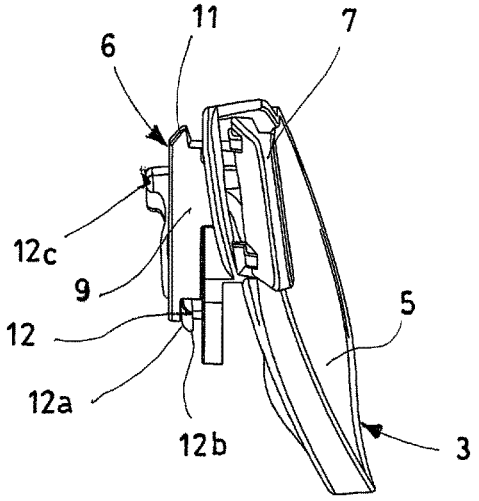
FIG. 15 is a bottom view of the coupling and decoupling element of FIGS. 1 to 9 and 11 to 14.
Figure 16:
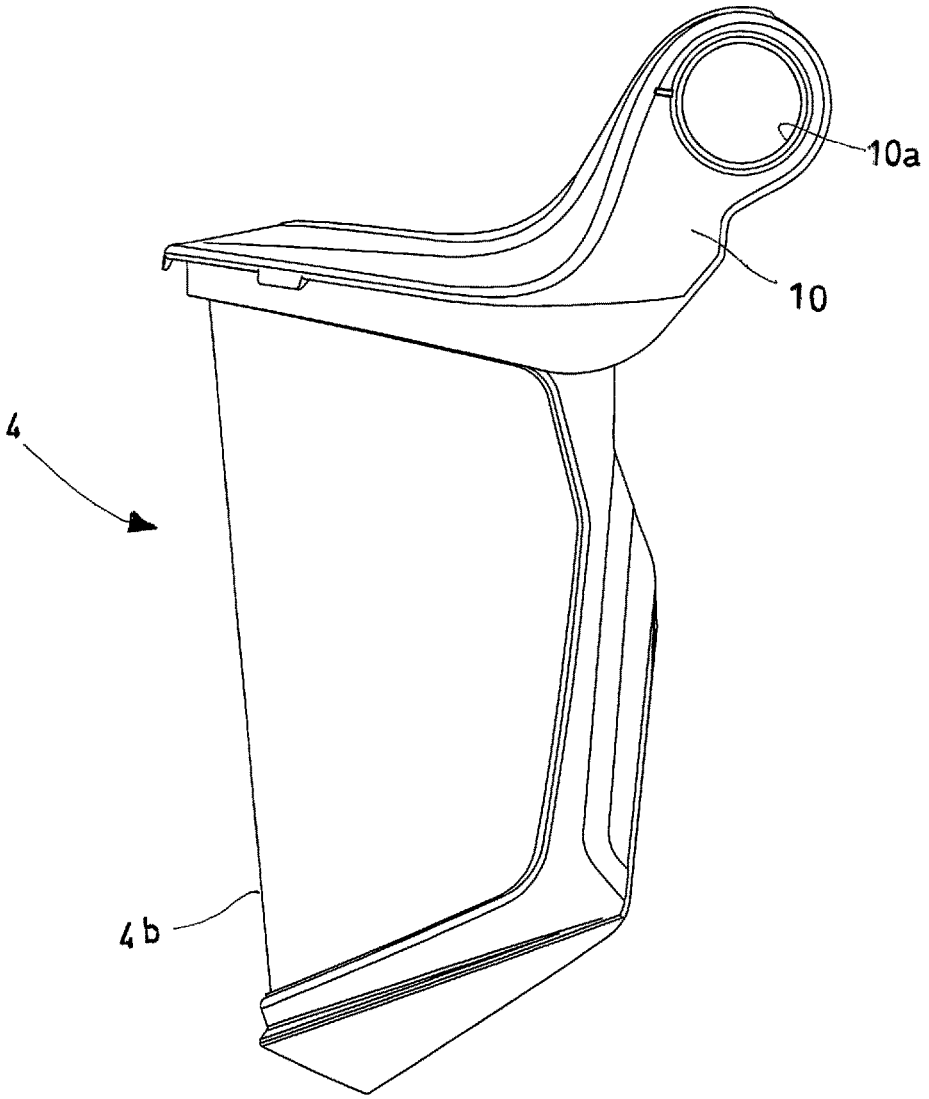
FIG. 16 is a lateral view of the accessory mounted on the helmet shown in FIG. 9, to highlight the engagement seat intended for coupling to the coupling and decoupling element of the helmet.

Still with reference to FIGS. 14 and 15, the movable abutment element 12 has a profile, in longitudinal section, also having a second inclined surface 12*b*, transversal to the first one 12*a*, tapering from the body 5 of the respective coupling and decoupling element 3 away from the respective engagement portion 9 of the respective coupling mechanism 6. The second inclined surface 12*b* switches the respective movable coupling abutment 12 from the first to the second position when an engagement portion 10 of an accessory 4, fitted on the respective engagement portion 9 of the respective coupling mechanism 6 of the respective coupling and decoupling element 3, is pulled away from the body 5 of the respective one of the latter.

Preferably, the inclination of the second surface 12*b* of the movable coupling abutment 3 is greater than the inclination of the first surface 12*a*, such as to require—in order to switch the latter from the first position to the second position—a force greater than the force required for performing such switching by acting on the first surface 12*a* of the movable coupling abutment 12.

The application, by pushing, of an accessory 4 on the coupling and decoupling elements 3 is easier than the removal, by tearing, of the accessory 4 from the coupling and decoupling elements 3.

In order to allow the manual switching of the movable coupling abutment 12 of the coupling mechanism 6 of each coupling and decoupling element 3, the movable coupling abutment 12 comprises at least one gripping portion 12*c*, which projects in a transversal manner with respect to the main development of the movable coupling abutment itself.

As seen in FIGS. 11 and 12, the body 5 of each coupling and decoupling element 3 is also provided with an arched portion 14, which substantially reproduces a portion of the profile of the engagement portion 9 of the respective coupling mechanism 6.

The arched portion 14 has a resting edge 14*a* on which a resting pin (not visible in the appended figure) slides, which pin projects from the respective engagement portion 10 of an accessory mounted on the helmet 1 when lifting or lowering the latter.

The resting edge 14*a* is advantageously provided with at least two concavities 14*b*, which correspond to the lifted and the lowered position of the accessory 4.

Advantageously, the engagement portion 10 of the accessory 4 and/or the resting pin of the same are elastically deformable, so as to enable the displacement of the pin from a concavity 14*b* to the other during the ascent or the descent of the accessory 4.

The helmet according to the present invention solves the problems observed in the known technique and achieves important advantages.

Firstly, the coupling and decoupling elements provided on the helmet described above notably facilitate the application or removing operations of the face protection accessories, making said operations practical and easy to perform.

Furthermore, the coupling and decoupling elements ensure a secure and firm connection between the helmet and the mounted accessory.

It should also be added that the coupling and decoupling elements guide the ascent and the descent of the accessories mounted along a regular path, without any movement that is transversal to the ascent and the descent.

It should also be noted that the ability of removing the coupling and decoupling elements from the helmet allows the maintenance thereof, when needed, or the substitution of the same with other identical or different coupling and decoupling elements.

Lastly, it should be pointed out that the coupling and decoupling elements allow a face protection accessory to be promptly replaced with another different one having the same engagement portions.

The invention claimed is:

1. A helmet, comprising a structure having:

at least one substantially convex outer surface; and at least one substantially concave inner surface adapted to receive the user's head in engagement;

wherein the helmet having two coupling and decoupling elements for engaging at least one accessory, which is engageable on a lateral portion of the outer surface of the structure, each coupling and decoupling element being removable from the helmet and having a body having at least one coupling mechanism that allows the engagement and disengagement of the accessory to/from the helmet when the coupling and decoupling elements are engaged on the latter, each element for coupling and decoupling the accessory comprising at least one attachment portion insertable in at least one respective attachment opening obtained on the helmet, the coupling mechanism of each element for coupling and decoupling the accessory comprises:

at least one engagement portion projecting from the respective body transversely with respect to the main development of the respective attachment portion, the engagement portion being shaped so as to receive a respective engagement portion of each accessory in engagement, whereon an engagement seat is obtained, the engagement seat being at least partially counter-shaped with respect to the engagement portion of the coupling mechanism of the respective coupling and decoupling element;

at least one fixed coupling abutment transversely projecting from the engagement portion of the coupling mechanism, the engagement portion of each accessory being interposed between the respective fixed coupling abutment and the respective body of the latter when it is in the mounted condition on the respective coupling and decoupling element; and at least one movable coupling abutment transversely projecting from the engagement portion of the coupling mechanism, on the opposite side with respect to the fixed coupling abutment, the movable coupling abutment being switchable between a first position, in which it projects at least partially from the engagement portion of the coupling mechanism in order to hold a respective engagement portion of each accessory when the latter is mounted on the respective coupling and decoupling element, and a second position, in which it does not project from the engagement portion of the coupling mechanism allowing the application of an accessory on the respective coupling and decoupling element or the removal of the same from the respective coupling or decoupling element.

2. The helmet according to claim 1, wherein each attachment opening is obtained through the perimeter edge of the helmet and develops substantially parallel or tangential with respect to the outer surface of the latter, thus the engagement of the respective element for coupling and decoupling the accessory is performed along a direction substantially parallel or tangential with respect to the outer surface of the helmet.

3. The helmet according to claim 1, wherein the attachment portion of each element for coupling and decoupling the accessory is insertable in a snap-fit manner into the respective attachment opening of the helmet.

4. The helmet according to claim 1, wherein the attachment portion of each element for coupling and decoupling the accessory is engageable by interference in the respective attachment opening of the helmet.

5. The helmet according to claim 1, wherein each attachment opening of the helmet is substantially square-shaped, and the attachment portion of each element for coupling and decoupling the accessory is substantially plate-shaped with a substantially square-shaped section.

6. The helmet according to claim 5, wherein the attachment portion of each coupling and decoupling element extends cantilevered from the body of the latter, the attachment portion tapering away from the body and ending with an enlarged end defining at least one abutment tooth for engaging a respective abutment edge of the respective attachment opening arranged inside the helmet.

7. The helmet according to claim 1, wherein the attachment portion of each element for coupling and decoupling the accessory is elastically deformable, at least transversely with respect to its longitudinal extension, in order to guarantee its snap-fit engagement in the respective attachment opening of the helmet and the disengagement from the same.

8. The helmet according to claim 1, wherein the movable coupling abutment of the coupling mechanism of each element for coupling and decoupling the accessory is operatively associated with an elastic return means, that maintains or returns the respective movable coupling abutment to the first position, in the absence of forces capable of leading the latter towards the second position.

9. The helmet according to claim 8, wherein the movable abutment element has a profile, in longitudinal section, having at least one first inclined surface tapering towards the body of the respective coupling and decoupling element away from the respective engagement portion of the respective coupling mechanism, the first inclined surface switching the respective movable coupling abutment from the first position to the second position when an engagement portion of an accessory is fitted on the respective engagement portion of the respective coupling mechanism of the respective coupling and decoupling element and pushed towards the body of the latter.

10. The helmet according to claim 9, wherein the movable abutment element has a profile, in longitudinal section, having a second inclined surface tapering from the body of the respective coupling and decoupling element away from the respective engagement portion of the respective coupling mechanism, the second inclined surface switching the respective movable coupling abutment from the first position to the second position when an engagement portion of an accessory, fitted on the respective engagement portion of the respective coupling mechanism of the respective coupling and decoupling element, is pulled away from the body of the respective coupling and decoupling element, the inclination of the second surface of the movable coupling abutment being such as to require in order to switch the latter from the first position to the second position—a force greater than the force required for performing such switching by acting on the first surface of the movable coupling abutment, thus the application, by pushing, of the accessory on the coupling and decoupling elements is easier than the removal, by tearing, of the accessory from the coupling and decoupling elements.

11. The helmet according to claim 10 wherein the movable coupling abutment of the coupling mechanism of each coupling and decoupling element comprises at least one gripping portion for manually switching the same from the first position to the second position.

12. The helmet according to claim 1, wherein the accessory is a face protection accessory selected from the group consisting of a visor, a mask, a net, and similar accessories.

13. The helmet according to claim 12, further comprising the face protection accessory.

14. The helmet according to claim 1, wherein the helmet is a work or sports protective helmet.

* * * * *